US010862240B2

(12) United States Patent
Bakshan et al.

(10) Patent No.: US 10,862,240 B2
(45) Date of Patent: Dec. 8, 2020

(54) TOP-LOADED ELECTRONIC CONNECTION SYSTEM

(71) Applicant: FCI USA LLC, Etters, PA (US)

(72) Inventors: Boris Bakshan, Beer Sheva (IL); Michael Scholeno, York, PA (US); Daniel Dillow, Etters, PA (US); Jordan Winey, Middletown, PA (US)

(73) Assignee: FCI USA LLC, Etters, PA (US)

( * ) Notice: Subject to any disclaimer, the term of this patent is extended or adjusted under 35 U.S.C. 154(b) by 54 days.

(21) Appl. No.: 16/383,533

(22) Filed: Apr. 12, 2019

(65) Prior Publication Data

US 2019/0319395 A1 Oct. 17, 2019

Related U.S. Application Data

(60) Provisional application No. 62/656,507, filed on Apr. 12, 2018.

(51) Int. Cl.

| | |
|---|---|
| ***H01R 13/66*** | (2006.01) |
| ***H01R 13/514*** | (2006.01) |
| ***H01R 24/28*** | (2011.01) |
| ***H01R 31/06*** | (2006.01) |
| ***H01R 13/627*** | (2006.01) |
| ***H01R 12/70*** | (2011.01) |
| *H01R 13/10* | (2006.01) |

(Continued)

(52) U.S. Cl.

CPC ..... *H01R 13/514* (2013.01); *H01R 12/7023* (2013.01); *H01R 13/6273* (2013.01); *H01R 24/28* (2013.01); *H01R 31/06* (2013.01); *H01R 13/04* (2013.01); *H01R 13/10* (2013.01); *H01R 2107/00* (2013.01)

(58) Field of Classification Search

CPC ..... H01R 13/6594; H05K 2201/10121; G02B 6/24

USPC ..... 439/607.2, 607.21

See application file for complete search history.

(56) References Cited

U.S. PATENT DOCUMENTS 6,600,865 B2 * 7/2003 Hwang ..... H01R 13/659 385/134

7,896,659 B1 * 3/2011 Westman ..... H01R 13/6471 439/75

(Continued)

OTHER PUBLICATIONS

U.S. Appl. No. 16/388,560, filed Apr. 18, 2019, Chen.

*Primary Examiner* — Phuong K Dinh

(74) *Attorney, Agent, or Firm* — Wolf, Greenfield & Sacks, P.C.

(57) ABSTRACT

An input/output connector system with a cable assembly that routes signals over a circuit board to which a receptacle connector is attached. A cage housing the receptacle has a channel with an opening at one end for mounting in a panel opening. The cage has an opening in a top surface through which a plug may be inserted into the channel to mate with the receptacle. The cage may be formed with one or more keys that engage channels on the plug to constrain motion of a plug inserted through the top surface to a direction perpendicular with the circuit board until the plug is inserted sufficiently into the cage that it can slide towards the receptacle without damaging the plug or receptacle. The plug may have one or more latch components on the sides, which engage with corresponding latch components on the cage when the plug is slid into engagement with the receptacle connector.

31 Claims, 8 Drawing Sheets

(51) Int. Cl.
*H01R 107/00* (2006.01)
*H01R 13/04* (2006.01)

(56) References Cited

U.S. PATENT DOCUMENTS

| | | | |
|---|---|---|---|
| 10,153,571 | B2 | 12/2018 | Kachlic |
| 2012/0003848 | A1 | 1/2012 | Casher et al. |
| 2017/0077643 | A1 | 3/2017 | Zbinden et al. |
| 2019/0326703 | A1 | 10/2019 | Chen |

* cited by examiner

TOP-LOADED ELECTRONIC CONNECTION SYSTEM

CROSS-REFERENCE TO RELATED APPLICATIONS

This Application claims the benefit under 35 U.S.C. § 119(e) of U.S. Provisional Patent Application Serial No. 62/656,507, filed on Apr. 12, 2018 under Attorney Docket No. A1156.70704US00, entitled "TOP-LOADED ELECTRONIC CONNECTION SYSTEM," which is hereby incorporated herein by reference in its entirety.

BACKGROUND

An electronic system may include one or more input/output (I/O) connectors for connecting two or more electronic devices with a cable which is terminated at one or both ends with an I/O connector. The cable may be constructed to carry electrical and/or optical signals. For transmitting optical signals, a transceiver is provided at one end of the cable for converting the optical signals to electrical signals.

Quad Small Form-factor Pluggable (QSFP) defines interface requirements for data communications applications. QSFP is defined in a multi-source agreement (MSA) under the auspices of the Small Form Factor (SFF) Committee. The MSA defines, among other interface requirements, a form factor and electrical interface for a compact, hot-pluggable transceiver. Components meeting the QSFP requirements are frequently used to connect networking hardware (such as servers and switches) to a fiber optic cable or active or passive electrical copper connection.

QSFP defines both a plug, which is typically attached at the end of a cable assembly, and a receptacle, which is typically mounted on a printed circuit board (PCB). To block electromagnetic interference (EMI), the receptacle may be located within a metal cage also mounted to the PCB. The receptacle is typically set back from the edge of the PCB and located at the back portion of the cage. The front portion of the cage usually extends through a panel of an electronic device and has an opening for receiving the plug and transceiver, if used. A channel extends from the opening at the front portion of the cage toward the rear portion to guide the plug into engagement with the receptacle. Such an arrangement may be used to connect a circuit board inside an electronic device to an external device using a cable.

SUMMARY

According to one aspect, an electronic system comprises a cable including a plurality of signal conductors, a circuit board including a surface, a receptacle connector mounted to the surface of the circuit board, a cage mounted to the surface of the circuit board and housing the receptacle connector therein, and a plug including a lower portion and an upper portion. The cage includes an upper wall positioned above the surface of the circuit board and forming a channel therebetween. The plug extends through the opening in the upper wall of the cage. The lower portion of the plug includes a mating interface positioned in the channel and engaging the receptacle connector. The upper portion of the plug is positioned outside the channel and attached to the cable. The plurality of signal conductors of the cable are electrically coupled to the mating interface of the plug.

According to another aspect, a cable assembly is provided for mating with a receptacle housed within a cage mounted on a circuit board, the cage having an opening in a top thereof for receiving the cable assembly to mate with the receptacle. The cable assembly comprises a plug and a cable connected to the plug. The plug includes a housing and a plurality of electrical contacts extending from the housing in a first direction, the plurality of electrical contacts arranged in a plane and configured to engage with the receptacle. The cable extends from the housing in a direction parallel to the plane and offset from the plane in a direction perpendicular to the plane.

According to another aspect, a cage is provided for housing a receptacle connector mounted to a circuit board and receiving a plug configured to mate with the receptacle connector. The cage comprises a plurality of conductive walls including an upper wall, a pair of side walls connected to the upper wall and an end wall connected to the side walls. The plurality of conductive walls bounding a channel having a first opening at a first end thereof and the end wall at a second end thereof, the second end being located opposite the first end. The upper wall includes a second opening therethrough configured to receive the plug into the channel. The cage further comprises a plurality of tails configured to mount the cage to the circuit board, the plurality of tails extending from a portion of the side walls located opposite the upper wall, and at least one cage latch located outside the channel and adjacent the second opening. The at least one cage latch extends from at least one of the plurality of conductive walls in a direction perpendicular to the upper wall. The at least one cage latch is configured to secure the plug when the plug is mated with the receptacle connector.

According to another aspect, an electronic system comprises a receptacle mounted to a surface of a circuit board, a cage mounted to the surface of the circuit board with the receptacle housed within the cage, and a cable assembly including a plug and a cable connected to the plug. The plug is configured to be coupled to the receptacle to establish an electrical connection therebetween. The plug includes a plurality of electrical contacts extending in a first direction to engage with the receptacle. The cable extends from the plug in the first direction.

According to another aspect, an electronic system comprises a cage configured to be mounted to a surface of a circuit board and to house a receptacle connector therein. The cage includes an upper wall that is to be positioned above the surface of the circuit board and form a channel therebetween when mounted to the circuit board. The electronic system also comprises a plug configured to be inserted through the opening in the upper wall of the cage and into the channel in a first direction and to be moved along the channel in a second direction transverse to the first direction for establishing engagement with the receptacle.

According to another aspect, a method is provided of interconnecting a plug to a receptacle connector mounted to a surface of a circuit board. The receptacle connector is housed within a cage mounted to the surface of the circuit board. The method comprises acts of: (a) inserting the plug into the cage in a first direction toward the surface of the circuit board; (b) after act (a), moving the plug in a second direction transverse to the first direction and toward the receptacle connector; and (c) in response to act (b), mating the plug and the receptacle connector to establish an electrical connection therebetween.

The foregoing is a non-limiting summary of the invention, which is defined by the appended claims.

DETAILED DESCRIPTION

Figure 1:
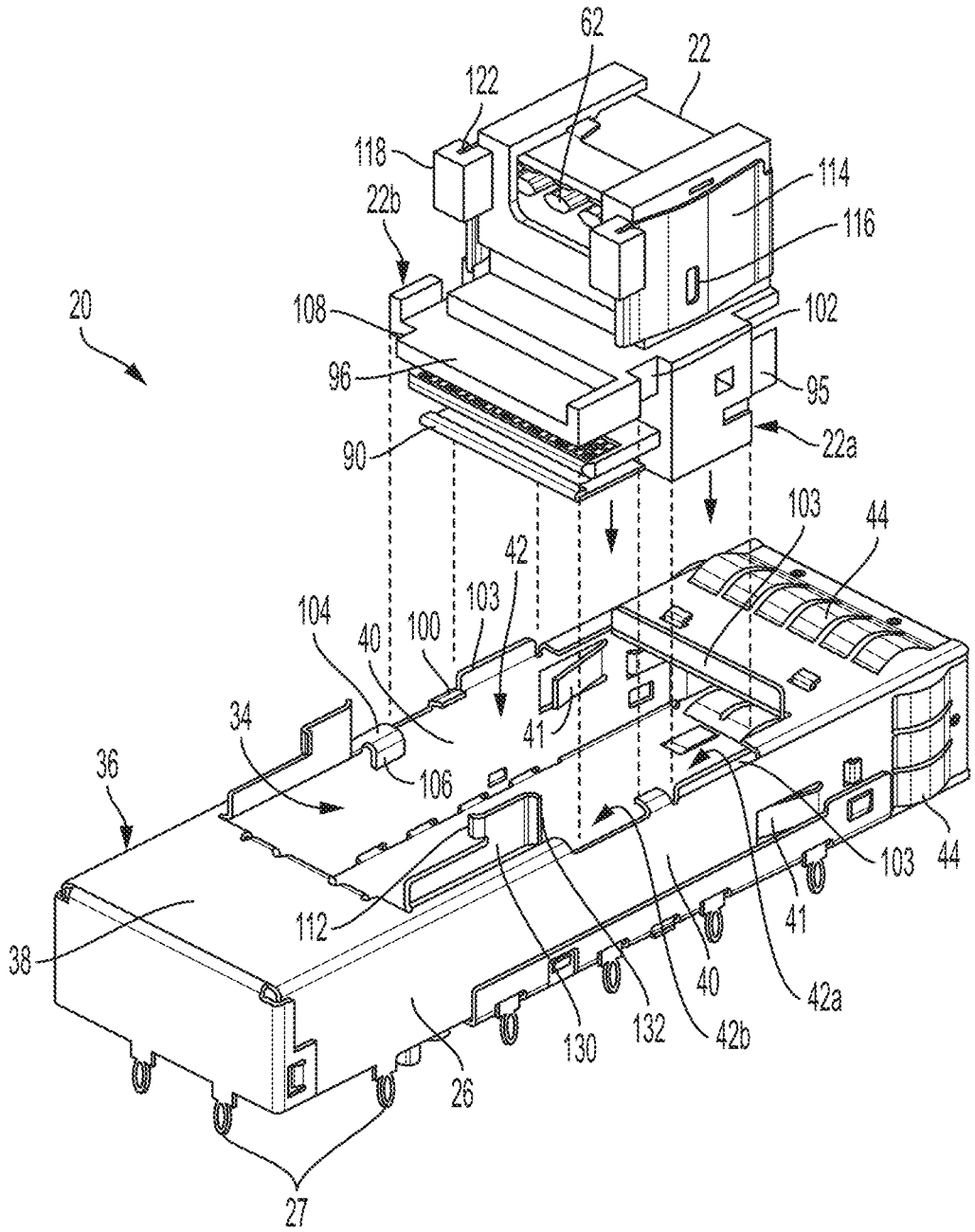
FIG. 1 is a rear perspective view of an electronic connection system according to one embodiment.

It should be understood that aspects of the disclosure are described herein with reference to certain illustrative embodiments and the figures. The illustrative embodiments described herein are not necessarily intended to show all aspects of the disclosure, but rather are used to describe a few illustrative embodiments. Thus, aspects of the disclosure are not intended to be construed narrowly in view of the illustrative embodiments. In addition, it should be understood that aspects of the disclosure may be used alone or in any suitable combination with other aspects of the disclosure.

For ease of understanding, aspects of the disclosure are described below in connection with a QSFP cage, plug and receptacle arrangement. However, it is to be appreciated that one or more aspects of the disclosure may be implemented with other electronic connection systems.

The inventors have recognized and appreciated designs that enable use of a single circuit board including a cage, such as an electromagnetic interference (EMI) cage, and a receptacle connector housed within the cage in either of two configurations without modification. In a first configuration, the connection system allows a circuit board to be used in a conventional I/O arrangement with the cage extending through an external panel of the electronic device to present an externally accessible opening for receiving and guiding a QSFP transceiver, or other plug, into engagement with the receptacle located within an electronic device. In a second configuration, the connection system allows the circuit board to be used for an alternate configuration in which the cage opening may not be accessible to receive a plug in a conventional manner external to the electronic device for connecting a cable to the receptacle. For example, and without limitation, the connection system may allow the use of an internal cable arranged in a flyover configuration. In a flyover configuration, a cable may connect locations within the same enclosure for an electronic device, including locations on the same circuit board. In some instances, the cable is routed over the circuit board to which one end of the cable is connected. The second end of the cable may be connected to a second location on the same circuit board or to a second circuit board that is parallel to the circuit board.

The present disclosure is directed to an electronic connection system including a cage, such as an EMI cage, which is configured to be mounted to a circuit board and receive a transceiver or plug through an opening and into a channel for guiding the transceiver or plug into engagement with a receptacle connector located within the cage at one end of the channel. The cage may include an upper wall and side walls which together define the channel with the upper wall being spaced from the circuit board by the side walls.

In some embodiments, the opening may be located in the upper wall of the cage and configured to receive the transceiver or plug in a first direction toward the circuit board. A separate opening may be provided at an end of the channel opposite the receptacle, such as in a conventional QSFP arrangement, to receive the transceiver or plug in a conventional manner. In this regard, the cage may be configured to be compliant with QSFP standards. The opening in the upper wall of the cage provides an alternate access point to the channel, for example, should the conventional opening be inaccessible or should it be desirable to access the cage channel from inside the electronic device.

The electronic connection system may also include a plug which is configured to be received through the opening in the upper wall of the cage and into the channel. Once received in the channel, the plug is configured to be moved along the channel in a second direction, which is transverse to the first direction, and into engagement with the receptacle connector. The plug may be configured to be compatible with a QSFP receptacle and cage. In this regard, the plug may be configured to be compliant with QSFP standards for use with the cage and a QSFP receptacle connector. In some embodiments, the plug may be configured to be inserted through the upper wall of the cage in a direction generally perpendicular to the circuit board and thereafter be slid along the channel in a direction generally parallel to the circuit board.

According to some aspects, the plug may be part of a cable assembly used to interconnect the receptacle connector to one or more other electronic devices and/or electronic components. The plug may be configured to orient the cable as it extends from the plug in a predefined direction relative to the electrical contacts of the plug. In some embodiments, the plug may include a paddle card which includes electrical contacts and is configured to be mated with the receptacle connector. The plug may be configured to orient the cable so as to extend from the plug in the same direction as the paddle card. The plug may also be configured to position the cable outside the cage. For example, and without limitation, the plug may include an upper portion configured to extend through the upper wall of the cage and remain positioned outside the cage channel when the plug is inserted in the cage and mated with the receptacle connector. The cable may be coupled to and extend from the upper portion of the plug. The inventors have recognized that such a cable arrangement may be particularly suited for use as a flyover cable for an electronic device.

According to some aspects, the cage and/or the plug may be configured with one or more features to ensure proper orientation and/or guidance of the plug relative to the cage. In some embodiments, the plug and cage may include cooperating features that constrain motion of the plug relative to the cage to the perpendicular direction until the mating interface of the plug is positioned fully within the channel and aligned with the receptacle at an end of the channel. Thereafter, motion may be constrained to the parallel direction to ensure proper mating without damage to either the plug or receptacle.

In some embodiments, the cage may include one or more guides at the opening in the upper wall which are configured to facilitate positioning and/or lead-in of the plug. The guides may be positioned about the opening and configured to engage portions of the plug to facilitate positioning and lead-in of the plug through the upper wall opening.

According to some aspects, a keying arrangement may be provided to ensure the plug is properly oriented relative to the cage and the receptacle connector. In this manner, the cage and/or the plug may include one or more keys configured to permit the plug to be inserted through the upper wall opening only when the plug is properly positioned and oriented relative to the cage. A keying arrangement may also be provided to permit the plug to be advanced along the cage channel to mate with the receptacle connector only when the plug has been fully inserted and positioned in the channel through the opening. In some embodiments, the same keying arrangement may be configured to permit insertion of the plug into the cage and subsequent mating of the plug to the receptacle connector only when the plug has been properly positioned relative to the cage.

In some aspects, the cage and/or the plug may include one or more features to secure the plug to the cage when the plug has been mated with the receptacle to reduce the potential of an inadvertent disconnection between the components. In one embodiment, the plug may include a latch configured to mate with one or more corresponding latch components, such as teeth, located on the cage. The latch may be movable between a latched position and an unlatched position. In the latched position, the latch engages the latch teeth and secures the plug in engagement with the receptacle connector. In the unlatched position, the latch is released and disengaged from the latch teeth to permit disengagement and removal of the plug from the receptacle. The latch may be configured to be biased toward the latched position to provide a positive latching engagement with the cage which can be overcome by moving the latch, for example by squeezing the latch, against the biasing force.

To maintain compatibility of the cage and the receptacle connector for use with standard QSFP transceivers and plugs in a conventional manner, any guides, keys or latch arrangements for use with a plug and connection arrangements according to this disclosure may be located on portions of the cage which do not interfere with the use of standard transceivers and plugs. In some embodiments, the guides, keys and/or latch components may be located outside the cage channel to avoid interference with standard plug insertion. For example, and without limitation, the guides, keys and/or latch components may be located on and/or extend outwardly away from the upper wall of the cage or may extend parallel to the walls of the cage.

Figure 2:
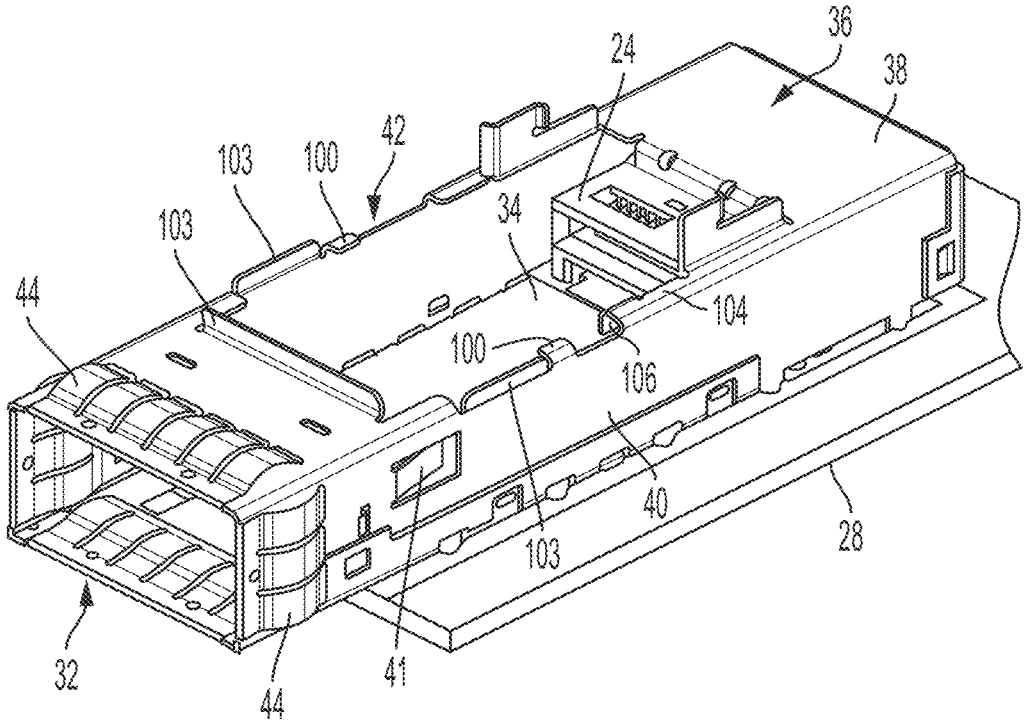
FIG. 2 is a front perspective view of a cage and a receptacle connector of the electronic connection system of FIG. 1 mounted to a circuit board.

In one illustrative embodiment shown in FIGS. 1-2, an electronic connection system 20 may include a plug 22 configured to mate with a receptacle connector 24 to establish electrical and/or optical connections therebetween. The connection system may also include a cage 26 configured to receive and guide the plug 22 into engagement with the receptacle 24 which is housed within the cage. The plug 22 may be a portion of a cable assembly, terminating one end of a cable, for example. However, for simplicity of illustration, the cable is shown cut away in FIG. 1.

As shown in FIG. 2, the cage 26 and the receptacle connector 24 may each be configured to be mounted to a circuit board 28. In the illustrative embodiment, cage 26 may include a plurality of tails 27 extending from a lower surface of the cage. As illustrated in FIG. 1, the tails may be configured as press fit tails for insertion into a via on a printed circuit board. The vias may include ground vias such that the tails provide both a mechanical attachment and an electrical connection to ground. The cage may be formed from one or more sheets of metal or other suitably conductive material and, in such embodiments, the tails may be stamped from the same sheet of material. However, any suitable board attachment may be used as should be apparent to one of skill in the art.

For some applications, the receptacle connector and the cage may be configured in accordance with one or more Small Form Factor (SFF) standards such as QSFP. In one embodiment, the cage may be configured to be compliant with SFF-8663 and be backwards compatible with QSFP modules. The receptacle may be a conventional connector with a mating interface configured to be compliant with SFF-8662. However, it is to be understood that the components of the electronic connection system may configured to be compliant with one or more other industry standards or no standards at all, if desired.

According to one aspect, the cage 26 may be configured to receive and guide a plug or transceiver module into engagement with the receptacle in different electronic system arrangements. In one arrangement, the cage 26 may be employed in a conventional manner to receive a QSFP transceiver or plug (not shown) through a front opening 32 in the cage and guide the transceiver or plug along an internal channel 34 into engagement with the receptacle connector 24 housed within the channel at the rear portion 36 of the cage. In this manner, the front end of the cage is configured to extend through an opening in a panel of an electronic device in a conventional arrangement to be accessible from outside the electronic device to receive the transceiver.

The cage 26 may include an upper wall 38 and side walls 40 which together define the channel with the upper wall being spaced from the circuit board 28 by the side walls. To secure a QSFP transceiver within the cage and in engagement with the receptacle in a conventional manner, a pair of transceiver latches 41 may be provided on the side walls 40 of the cage. The transceiver latches 41 may be configured and positioned within the cage to engage corresponding features on a QSFP transceiver which has been fully inserted into the cage and engaged with the receptacle. As shown, the transceiver latches may include resilient, inwardly angled fingers which are configured to be displaced outwardly to generate an inward biasing force as a transceiver is moved along the channel between the latches and toward the receptacle. The latches are configured to spring inwardly when the transceiver is fully inserted in the cage to engage corresponding features of the transceiver and thereby secure the transceiver.

In one embodiment, the cage may be configured to provide shielding from electromagnetic interference (EMI). In this manner, the cage may be formed from any suitable metal or other material for shielding against EMI as should be apparent to one of skill in the art. As illustrated, the cage may include an EMI gasket 44 located about the front opening 32 of the cage. In one embodiment, the EMI gasket 44 may include a plurality of finger gaskets as is known in the art.

Figure 3:
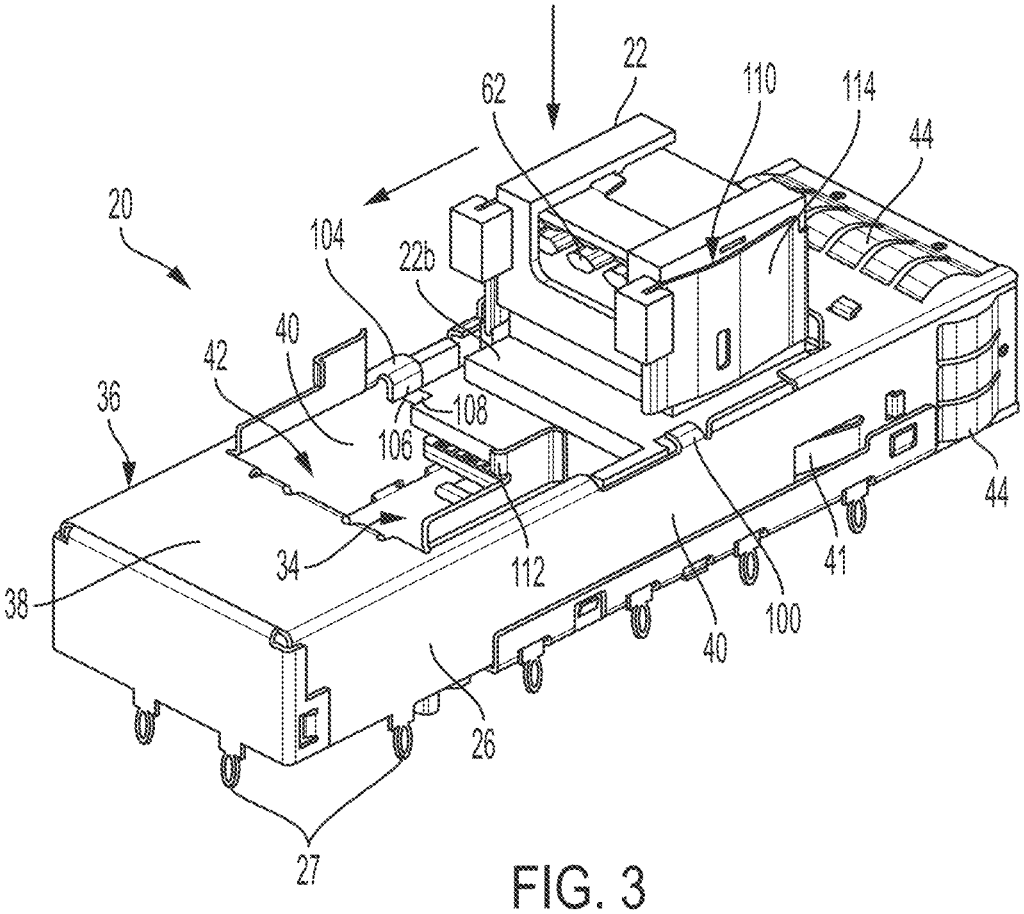
FIG. 3 is a rear perspective view of the electronic connection system of FIG. 1 with a plug inserted into the cage.
Figure 4:
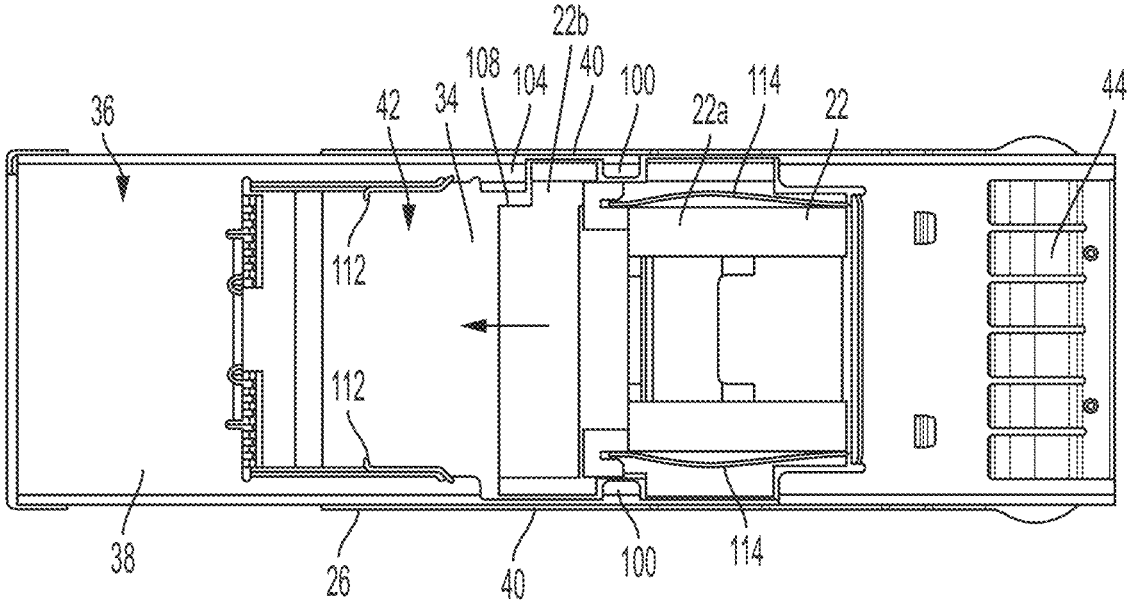
FIG. 4 is a top planar view of the electronic connection system of FIG. 3 illustrating the plug initially inserted into the cage.
Figure 5:
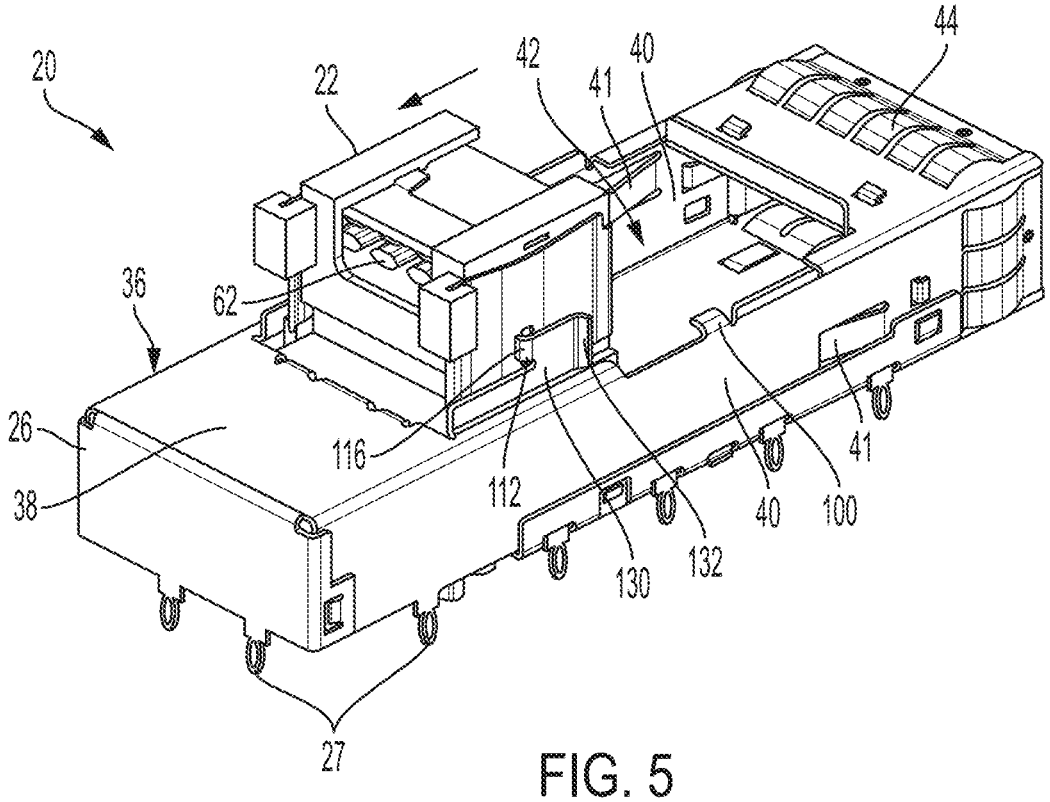
FIG. 5 is a rear perspective view of the electronic connection system of FIG. 1 with the plug moved along the cage into engagement with the receptacle connector.
Figure 6:
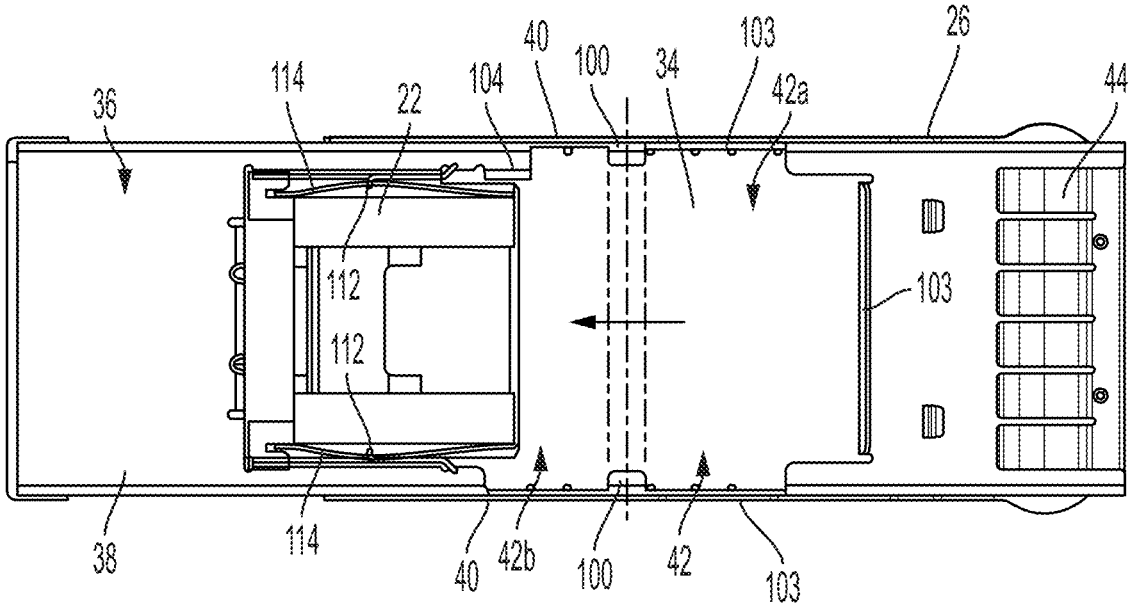
FIG. 6 is a top planar view of the electronic connection system of FIG. 5.

For some applications, the cage may be configured to receive the plug 22 through an opening 42 located in the upper wall 38 of the cage. As illustrated in FIGS. 1 and 3-4, the plug 22 may be top-loaded into the cage in a first direction toward the circuit board 28. Such an arrangement may be desirable when the front opening 32 is inaccessible and/or when it may be desirable to internally interconnect the circuit board to an electronic device and/or component using a cable, such as a flyover cable. As illustrated in FIGS. 5-6, once the plug 22 has been fully seated in the cage 26, the plug may be moved in a second direction, which is transverse to the first direction, along the channel 34 toward the rear portion 36 of the cage and into engagement with the receptacle connector.

In one embodiment, the plug 22 may be configured to be inserted through the upper wall 38 of the cage in a direction generally perpendicular to the circuit board and thereafter be slid along the channel in a direction generally parallel to the circuit board.

The plug 22 may be configured to be compatible with a QSFP cage and receptacle connector. In this regard, the plug may be configured to be compliant with QSFP standards for use with the cage 26 and a QSFP receptacle connector 24. In one embodiment, the plug may include a mating interface configured to be compliant with SFF-8662. However, it is to be understood that the plug interface may employ other configurations as should be apparent to one of skill in the art.

In one illustrative embodiment shown in FIGS. 7-10, the plug 22 may include a housing 50, an interconnection module 52, and a cover 54 to secure the interconnection module to the housing. Additionally or alternatively, the interconnection module may be directly secured to the housing, for example and without limitation, using a snap fit or an interference fit. The module 52 may include a paddle card 56 positioned in the housing with a first edge portion 58 extending in a first direction for mating with the receptacle connector.

The paddle card 56 may be configured to engage with the receptacle to establish electrical connections therebetween. In one embodiment, the paddle card 56 may include a circuit board with a plurality of contacts 60 distributed across the first edge portion which are electrically coupled to conductors within cables 62. In the illustrated embodiment, each of the cables 62 is a twin-a cable, with two conductors forming a differential pair, each of which is terminated, such as by soldering or welding, to a contact 60 on the paddle card 56. The cables 62 may alternatively contain grounding and or shielding structures, such as foil shields and/or drain wires. Such structures may also be terminated to grounding structures on the paddle card 56 using techniques as are known in the art, but those ground terminations are not shown for simplicity.

Figure 7:
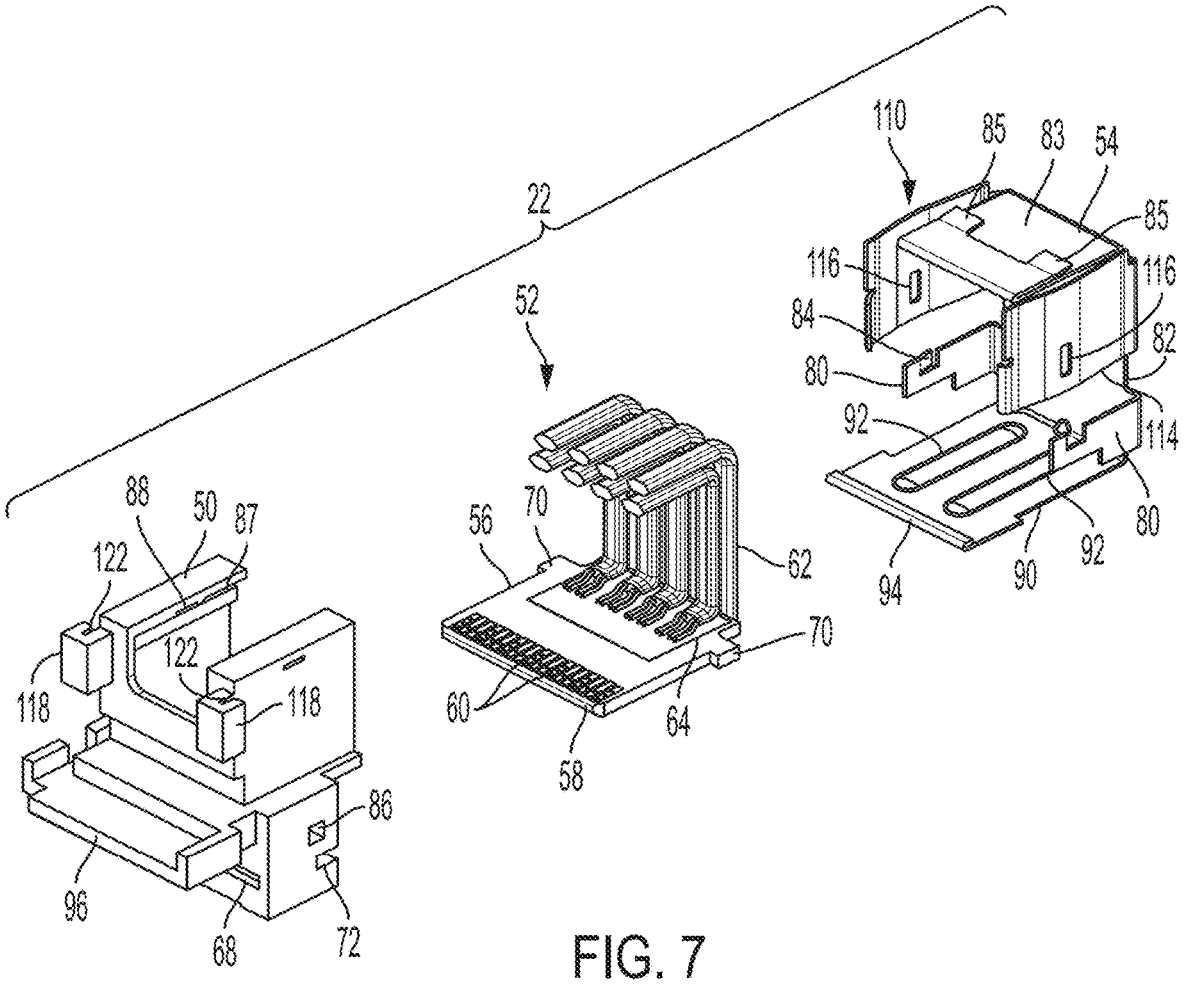
FIG. 7 is a front exploded view of the plug of FIG. 1 according to one embodiment.

As shown in FIG. 7, the cable leads 62 may be arranged to extend away from a rear portion 64 of the paddle card 56 in a direction perpendicular to its upper surface. However, it is to be appreciated that that cable leads may be arranged in any direction suitable for a particular application. To maintain the desired lead position as well as provide strain relief for the cable leads, the paddle card 56 and the cable leads 62 may be encapsulated by a material, such as by overmolding or using any suitable process as should be apparent to one of skill in the art to form the interconnection module.

Figure 8:
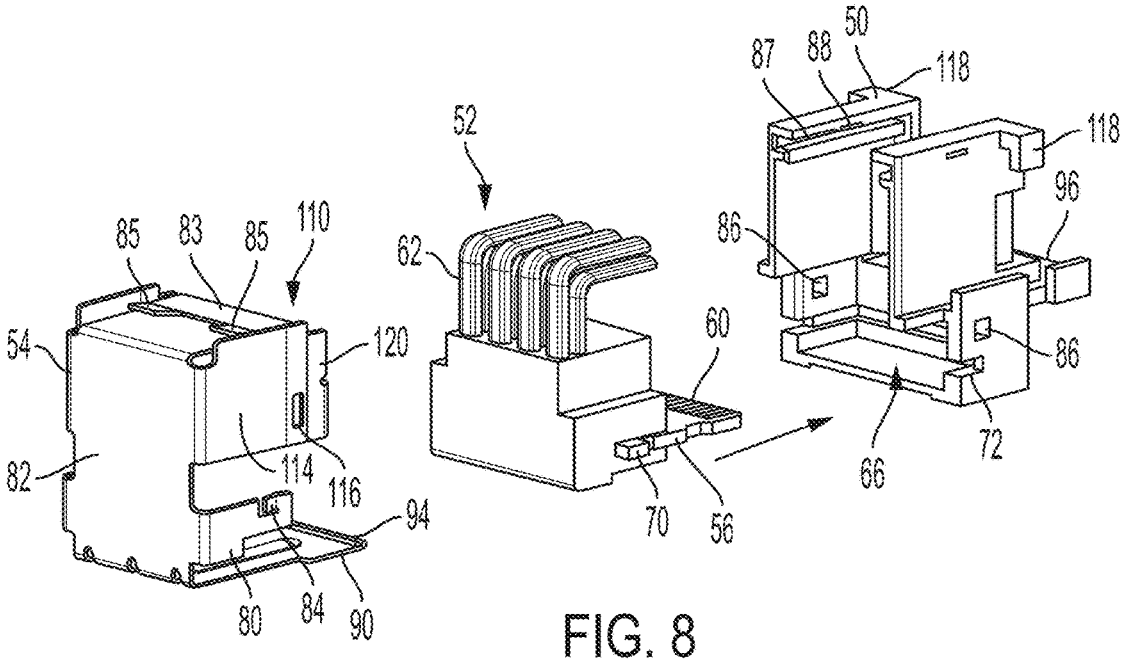
FIG. 8 is a rear exploded view of the plug of FIG. 7.

As shown in FIGS. 7-8, the housing 50 and interconnection module 52 may be configured so that the interconnection module may be assembled to the housing by inserting the module into a corresponding portion of the housing. In one embodiment, the housing may include a cavity 66 (FIG. 8) configured to receive a portion of the module therein with the first edge portion of the paddle card extending through an opening 68, such as a slot, in the front of the housing. The paddle card may include a pair of ears 70 extending from opposites sides to slidably engage rearwardly facing slots 72 on the housing.

Figure 9:
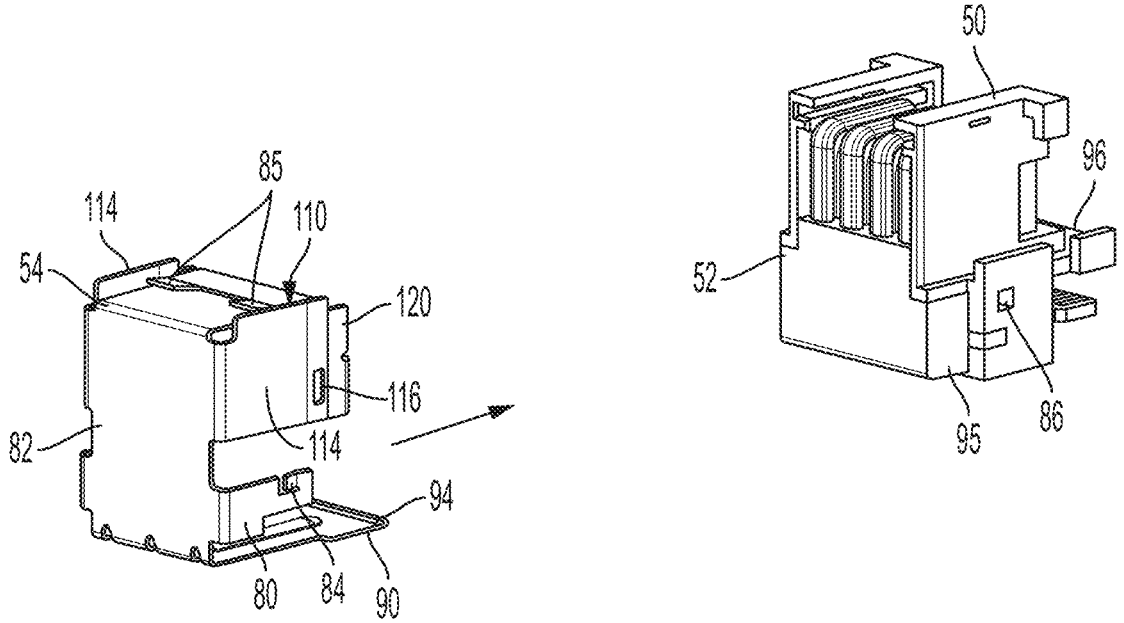
FIG. 9 is a rear exploded view of the plug of FIGS. 7-8 illustrating an interconnection module of the plug mated with a plug housing.
Figure 10:
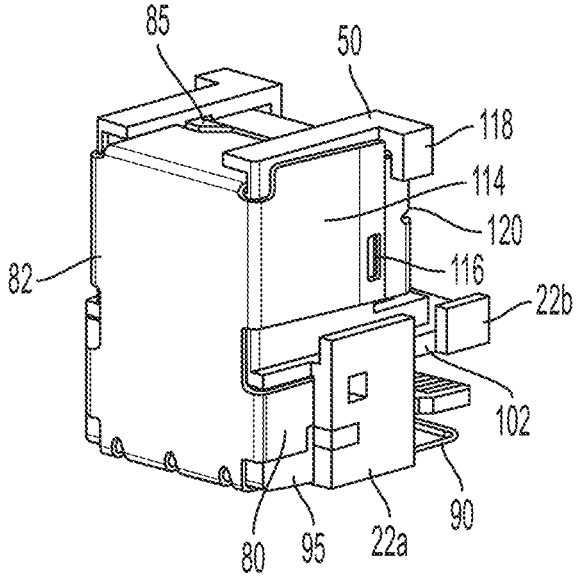
FIG. 10 is a rear perspective view of the assembled plug of FIGS. 7-9.
Figure 11:
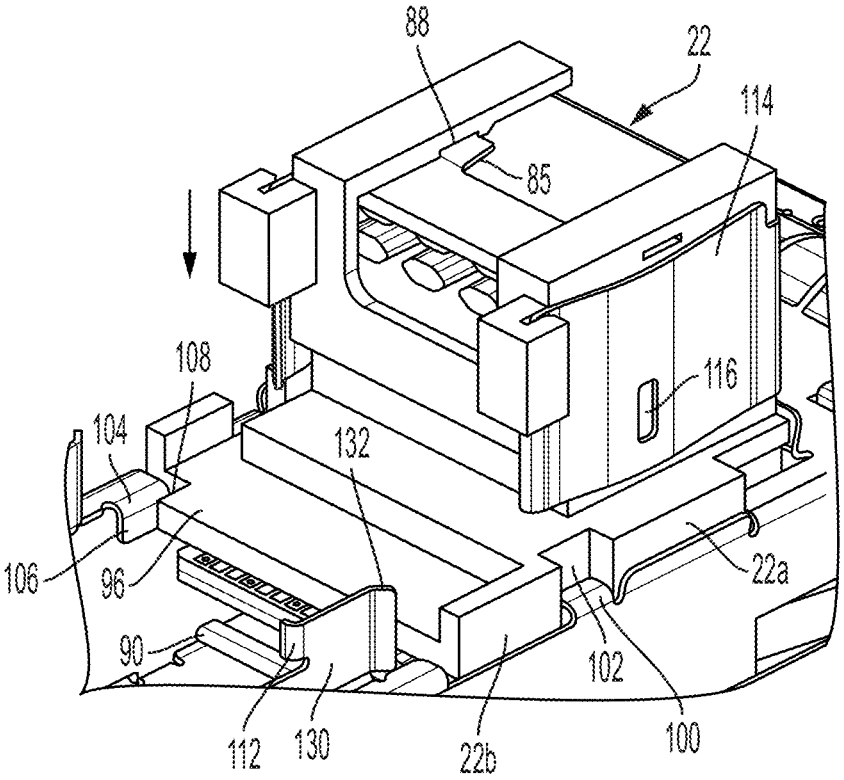
FIG. 11 is a partial front perspective view of the plug being positioned and guided into the cage with a keying arrangement according to one illustrative embodiment.
Figure 12:
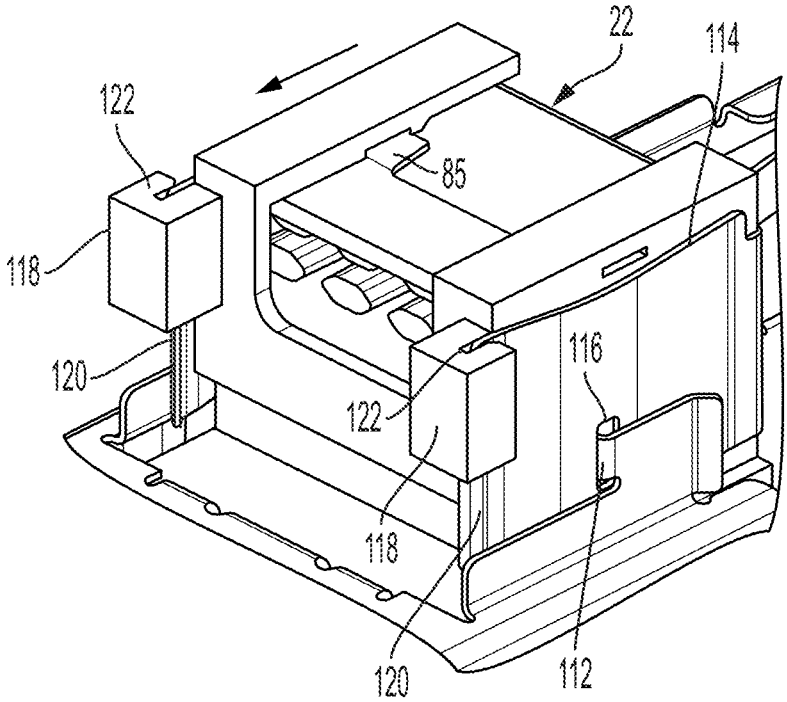
FIG. 12 is a partial front perspective view of the plug being secured to the cage with a locking arrangement according to one illustrative embodiment.

With the interconnection module loaded in the housing, the cables may be bent, as illustrated in one embodiment, toward an upper portion of the housing and in a forward direction toward the front of the housing so that the cables are positioned below the top of the housing. As shown in FIGS. 9-10, the cover 54 may then be attached to the housing 50 to capture the interconnection module 52 and maintain the cable leads down and in a forward extending position.

In one illustrative embodiment, the cover 54 may be configured to employ a snap-fit connection with the housing. As illustrated in FIGS. 7-8, the cover 54 may include a pair of arms 80 extending in a forward direction from the sides of a back wall 82 of the cover. The cover may also include a top wall 83 similarly extending in the forward direction from the top of the back wall 82. The arms and the top wall may be configured to be slid into engagement with corresponding internal portions, such as slots or channels, of the housing. In one embodiment, the housing may include a pair of channels 87 along a top portion thereof to receive the top wall of the cover.

In one embodiment, each arm 80 may be provided with a resilient locking finger 84 biased in an outward direction from the arm. In a similar manner, the top wall 83 may be provided with a pair of resilient locking fingers 85 biased in an outward direction from the wall. Each locking finger 84, 85 may be configured and arranged on the arm 80 and the top wall 83, respectively, to snap into and engage corresponding receptacles 86, 88, such as openings or notches, provided on each side and the top portion of the housing when the cover has been fully mated with the housing.

In one embodiment, the cover 54 may also include a bottom wall 90 extending in a forward direction from the bottom of the back wall 82. As illustrated, the bottom wall 90 may be configured to wrap under the bottom of the interconnection module 52 and the housing 50 to extend in a forward direction beyond the housing. In this manner, the bottom wall 90 may provide a lower tongue positioned below the front edge portion 58 of the paddle card 56 to protect the paddle card from inadvertent contact when the plug is removed from the cage.

To enhance the structural integrity of the tongue, the bottom wall 90 may include one or more features configured to stiffen and/or strengthen the tongue. In one embodiment, the bottom wall may include one or more stiffeners, such as ribs and/or folded edges, configured to increase the stiffness of the tongue. As illustrated in FIG. 7, the bottom wall 90 may include a pair of ribs 92 extending along the wall in the forward direction to increase the longitudinal stiffness of the tongue. If desired, the front edge 94 of the bottom wall may be folded over to increase the lateral stiffness of the tongue. However, it is to be understood that the bottom wall may include any suitable features to enhance the structural integrity of the tongue, if desired, as should be apparent to one of skill in the art.

For some applications, it may be desirable to protect the paddle card not only from the bottom, but from the top as well. In one embodiment, the plug 22 may include an upper tongue 96 extending in the forward direction above the paddle card to protect the paddle card from inadvertent contact from above when the plug is removed from the cage. The upper tongue may be formed by a shelf portion of the housing.

The illustrated embodiment of fabricating and assembling the plug may provide one or more benefits associated with costs and ease of manufacture. However, it is to be appreciated that the plug cover may be attached to the housing 50 using any suitable connection arrangement apparent to one of skill in the art.

In one embodiment, such as for a low power application which generates a relatively low amount of heat, the housing and the cover may be molded from a plastic material including, but not limited to, a plastic material which has electrical insulating properties. In another embodiment, such as for a high power application which generates a relatively high amount of heat, the housing and/or the cover may be fabricated from a metal material having a high thermal conductivity for dissipating heat. However, the housing and/or the cover may be fabricated from any material and using any fabrication technique for a particular application as should be apparent to one of skill in the art.

According to some aspects, the cage 26 and/or the plug 22 may be configured with one or more features to ensure proper orientation and/or guidance of the plug relative to the cage. In some embodiments, the cage may include one or more guides at the opening 42 in the upper wall 38 which are configured to facilitate positioning and/or lead-in of the plug. The guides may be positioned about the opening and configured to engage portions of the plug to facilitate positioning and lead-in of the plug through the upper wall opening.

In one embodiment illustrated in FIGS. 1-6, the plug 22 and the upper wall opening 42 may be configured with corresponding shapes that permit the plug to be inserted into the cage only when the plug is properly positioned and aligned with the opening. As shown in FIG. 6, the opening may include a first portion 42*a* and a second portion 42*b* for receiving corresponding portions of the plug. The first and second portions of the opening 42 may have different shapes relative to each other. Similarly, as illustrated in FIG. 1, the plug 22 may include first and second portions 22*a*, 22*b* having different shapes relative to each other and which closely correspond to first and second portions of the opening. In this manner, the plug 22 may be inserted into the cage 26 only when the first portion 22*a* of the plug is aligned with the first portion 42*a* of the opening and the second portion 22*b* of the plug is aligned with the second portion 42*b* of the opening.

In one embodiment, the first and second portions of the opening 42 may be separated by a key arrangement which is configured to be aligned with a corresponding key arrangement on the plug to allow insertion into the cage. As illustrated, the key arrangement may include a pair of opposing insertion keys 100 extending inwardly toward each other from the side walls 40 of the cage. The insertion keys 100 may be configured to engage corresponding features provided on the plug. In one embodiment, each side of the plug may include a key channel 102 between the first and second portions 22*a*, 22*b* of the plug with the key channels configured and arranged to receive the insertion keys 100 of the cage when the plug is properly positioned for insertion into the cage.

In one embodiment, the insertion keys 100 may include tabs extending inwardly from the top edge of the side walls 40 and located within the same plane as the upper wall 38. The insertion keys may be formed integral with the cage or be separate components attached to the cage. The insertion keys may have any configuration and be located at any suitable location of the cage as should be apparent to one of skill in the art.

As described above, the cage may include a pair of transceiver latches configured to secure a QSFP transceiver within the cage. The opening 42 on the cage and/or the plug 22 may be configured and arranged to permit insertion of the plug through the opening and into the channel of the cage while avoiding engagement with the transceiver latches. In one illustrative embodiment shown in FIGS. 9-10, the first portion 22*a* of the plug may be configured with notches 95 or other structural arrangement having a width which is less than the width between the transceiver latches at least at regions of the first portion 22*a* which may be positioned adjacent the transceiver latches when the plug is inserted into the cage.

For some applications, it may be desirable to provide a key arrangement which is configured to permit movement of the plug along the channel and toward the receptacle connector only when the plug has been fully seated in the cage. Such an arrangement may prevent movement of the plug along the channel even when the plug has been aligned and inserted into the cage to ensure the plug to properly aligned with the receptacle connector before allowing advancement of the plug toward and into engagement with the connector. Such an arrangement may reduce potential damage to the plug and/or the receptacle connector which could potentially occur when mating the components due to misalignment.

To facilitate alignment and insertion of the plug into the cage, it may be desirable to provide one or more guides configured to align and direct the plug through the opening and into the cage. In one illustrative embodiment, several alignment guides 103 may be provided about the first portion 42*a* of the opening. As illustrated, the guides 103 may extend in an upward direction from the upper wall 38 of the cage. The guides may be angled away from the opening in an upward direction away from the cage. In this manner, the guides may help align and funnel the plug through the opening.

The guides may be configured and arranged to form a second channel which extends in a direction transverse to and intersecting the cage channel 34. In this manner, the plug 22 may be guided by the second channel into the cage channel. In one embodiment, the second channel may be arranged orthogonal to the cage channel with the opening 42 defining a portion of the second channel.

In one embodiment illustrated in FIGS. 1, 3-4 and 11, the key arrangement may include a connection key 104 extending inwardly from one side wall 40 of the cage. As illustrated, the connection key 104 may be located at an end of the second portion 42*b* of the opening opposite the insertion keys 100. The connection key may include a finger 106 extending in a downward direction from its free end. The key finger 106 may be configured to extend a predetermined distance into the channel and obstruct passage of the plug 22 toward the receptacle connector 24 until the plug has been sufficiently seated in the cage to align the plug with the receptacle connector whereupon the second portion 22*b* of the plug can pass below the finger. In one embodiment, the second portion 22*b* of the plug may include a notch 108 or other relief configured to receive the key finger 106 when the plug is aligned with the opening and being initially inserted into the cage.

In one embodiment, the connection key 104 may include a tab extending inwardly from the top edge of the side wall 40 and be located within the same plane as the upper wall 38 with the finger 106 extending below the plane of the upper wall. The connection key may be formed integral with the cage or be a separate component attached to the cage. The connection key may have any configuration and be located at any suitable location of the cage as should be apparent to one of skill in the art.

Although the use of one or more key arrangements may be beneficial, it is to be understood that a key arrangement may not be required for each application of the electronic connection system. Moreover, it is to be understood that other key arrangements, if desired, may be employed with the connection system as should be apparent to one of skill in the art.

For some applications, it may be desirable to provide a latch arrangement to secure the plug to the cage when the plug has been mated with the receptacle connector to reduce the potential of an inadvertent disconnection between the components.

In one embodiment, the plug 22 may include a plug latch 110 configured to mate with one or more cage latch components 112 located on the cage 26. The plug latch 110 may be movable between a latched position and an unlatched position. In the latched position, the plug latch engages the cage latch and secures the plug in engagement with the receptacle connector. In the unlatched position, the plug latch is released and disengaged from the cage latch to permit disengagement and removal of the plug from the receptacle.

In one embodiment, the plug latch 110 may be configured to be biased toward the latched position to provide a positive latching engagement with the cage which can be overcome by moving the plug latch, for example by squeezing the latch, against the biasing force.

As illustrated in FIGS. 7-10, the plug latch may include a pair of latch arms 114 extending in a forward direction from the sides of the back wall 82 of the cover. Each latch arm 114 may include an opening 116 or other suitable feature configured to receive a latch tooth, or other cage latch component, provided on the cage latch when the plug has been mated with the receptacle connector. Each latch arm 114 may be configured to have an outward curvature so that the plug latch can be squeezed between the cage latch 112 as the plug is moved toward the connector to create an outward biasing force to secure the plug when the opening 116 becomes aligned with and receives the latch teeth 112. The latch arms may be squeezed against the outward biasing force to disengage the latch teeth from the openings to allow the plug to be disconnected from the connector and removed from the cage.

As illustrated, the plug housing 50 may include a pair of retainers 118 configured to engage and retain the front portion 120 of each latch arm. In one embodiment, each retainer may include a slot 122 configured to receive the front portion of the latch arm in a sliding relationship to allow the latch arms to slide within the retainer as the latch is squeezed and released during latching and unlatching.

To facilitate engagement of the plug latch with the cage latch teeth, it may be desirable to guide and/or actuate the plug latch as the plug is moved along the channel toward the receptacle connector. In one embodiment, a pair of latch guides 130 may extend in an upward direction from the upper wall of the cage. The cage latch teeth 112 may be positioned on a portion of the guides which align with the latch openings when the plug is fully engaged with the connector. As illustrated, the cage latch teeth may be angled in an inward direction towards each other to enter the latch openings. As illustrated, an end 132 of the latch guide may be angled in an outward direction to help align and direct the latch into the guide.

Although the use of a latch arrangement may be beneficial, it is to be understood that a latch arrangement may not be required for each application of the electronic connection system. Moreover, it is to be understood that other latch and/or latch guide arrangements, if desired, may be employed with the connection system as should be apparent to one of skill in the art.

According to some aspects, the plug 22 may be part of a cable assembly used to interconnect the receptacle connector 24 to one or more other electronic devices and/or electronic components.

Figure 13:
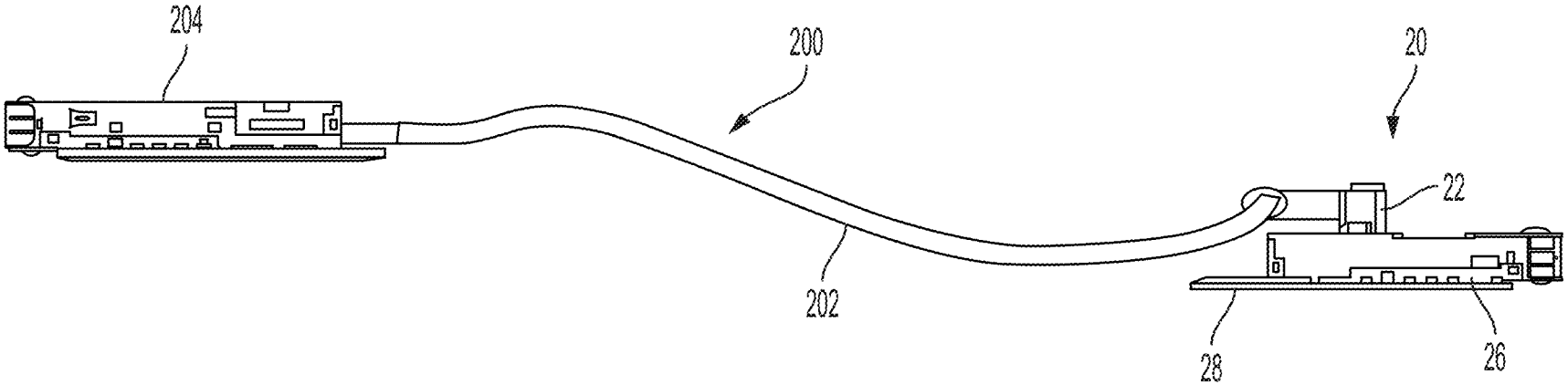
FIG. 13 is a schematic view of a cable assembly for use with the electronic system of FIGS. 1-12 according to one embodiment.

In one illustrative embodiment shown in FIG. 13, a cable assembly 200 may include a cable with a plug 22 coupled to one end of the cable. As shown, the opposite end of the cable may be coupled to another electronic device or component. The cable may be constructed to carry electrical and/or optical signals. For example, and without limitation, the cable 202 may be coupled to a QSFP cage and receptacle connector arrangement 204 configured to receive a conventional QSFP transceiver. However, it is to be appreciated that that cable may be coupled to any suitable electronic device as should be apparent to one of skill in the art.

In one embodiment, the cable assembly 200 may be configured with the cable 202 extending from the plug in the same direction as the paddle card. As shown, the plug 22 may be configured to position the cable 202 outside the cage 26. In this manner, the cable assembly may be particularly suited for use as a flyover cable for an electronic device.

In some embodiments, a plug may be interconnected to a receptacle connector mounted to a surface of a circuit board, the receptacle connector housed within a cage mounted to the surface of the circuit board, according to a method comprising acts of (a) inserting the plug into the cage in a first direction toward the surface of the circuit board; (b) after act (a), moving the plug in a second direction transverse to the first direction and toward the receptacle connector; and (c) in response to act (b), mating the plug and the receptacle connector to establish an electrical connection therebetween.

In such a method, the first direction may be perpendicular to the surface of the circuit board.

In such a method, the second direction may be parallel to the surface of the circuit board.

In such a method, the cage may include an upper wall spaced from the surface of the circuit board with a channel therebetween, the receptacle connector may be located between the upper wall and the circuit board at an end portion of the channel, the upper wall may include an opening configured to receive at least a lower portion of the plug therethrough and into the channel during act (a).

In such a method, the lower portion of the plug may be moved along the channel during act (b).

In such a method, the act (c) may include mechanically securing the plug to the cage.

Such a method may further comprise an act (d) of engaging a releasable plug latch on the plug to a corresponding cage latch on the cage.

In such a method, the plug may include an upper portion which remains outside the cage during each of acts (a) to (d), the plug latch may be located on the upper portion of the plug.

In such a method, the act (d) may include actuating the plug latch with the cage latch in response to act (b) and/or act (c).

In such a method, the act (d) may include engaging at least one latch opening on the plug latch with at least one latch projection on the cage latch.

Such a method may further comprise an act (e) of disengaging the plug latch from the cage latch to separate the plug from the receptacle connector.

In such a method, the act (e) may include squeezing the plug latch by hand.

In such a method, the plug latch may have an outwardly curved configuration in a direction away from a side of the plug, and act (e) includes squeezing the plug latch inwardly toward the side of the plug.

It should be appreciated that an interconnection system is not limited to the specific embodiments described above. For example, features may have been described in connection with one embodiment, but it should be understood that the disclosed features may be used in any suitable combination.

Further, variations on the specific exemplary embodiments are possible. For example, embodiments have been described in which an opening is provided in a top wall of a cage. An opening, alternatively or additionally, may be provided in a side wall of the cage.

As another example, a connection system compliant with the QSFP specification has been used as an example. The design techniques described herein may be used in any connection system with a receptacle/plug/cage configuration, including the SFP configuration and variations, such as SFP+, QSFP+, QSFP-DD and similar standards such as SONET, Gigabit Ethernet and Fiber Channel.

As yet another example of a variation, a port for a single port receptacle has been described. Ports may be ganged with one port stacked on top on another port or ports aligned side-by-side. Techniques, as described herein, may be used in such cages.

Further, terms such as upper, top, lower, and bottom are used to describe a relative position of components. These terms do not define an orientation relative to gravity or other fixed coordinate system. In some contexts, these terms will be understood to define an orientation relative to a circuit board to which a receptacle and cage are mounted or the surfaces of the receptacle and/or cage that are intended to be mounted against a circuit board.

For purposes of this patent application and any patent issuing thereon, the indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

The use of "including," "comprising," "having," "containing," "involving," and/or variations thereof herein, is meant to encompass the items listed thereafter and equivalents thereof as well as additional items.

It should also be understood that, unless clearly indicated to the contrary, in any methods claimed herein that include more than one step or act, the order of the steps or acts of the method is not necessarily limited to the order in which the steps or acts of the method are recited.

The foregoing description of various embodiments are intended merely to be illustrative thereof and that other embodiments, modifications, and equivalents are within the scope of the invention recited in the claims appended hereto.

What is claimed is:

1. A cable assembly configured for mating with a receptacle housed within a cage mounted on a circuit board, the cage having an opening in a top thereof for receiving the cable assembly to mate with the receptacle, the cable assembly comprising:

a plug including a housing and a plurality of electrical contacts extending from the housing in a first direction, the plurality of electrical contacts arranged in a plane and configured to engage with the receptacle; and a cable connected to the plug, the cable extending from the housing in a direction parallel to the plane and offset from the plane in a direction perpendicular to the plane.

2. The cable assembly of claim 1, wherein the plug includes a paddle card with an edge portion configured to mate with the receptacle, the electrical contacts being located along the edge portion with the edge portion extending in the first direction.

3. The cable assembly of claim 1, wherein:

the plug includes a plug latch configured to releasably engage a corresponding cage latch located on the cage; and the plug latch includes a sheet of metal with a first portion having an edge captured adjacent at least one side of the housing of the plug.

4. The cable assembly of claim 3, wherein:

the sheet of metal includes a second portion arranged parallel to the plane; and the plug includes a paddle card, the plurality of electrical contacts located on the paddle card, the second portion of the sheet of metal being located adjacent and parallel to the paddle card, the second portion sheet of metal being configured to protect the paddle card.

5. The cable assembly of claim 4, wherein the second portion of the sheet of metal is located below the paddle card, and wherein the housing of the plug includes a projecting portion located above and parallel to the paddle card, the projecting portion configured to protect the paddle card.

6. The cable assembly of claim 1, wherein the cable extends from the housing in the first direction.

7. The cable assembly of claim 6, wherein the cable includes a first portion arranged in the plug perpendicular to the plane and a second portion arranged in the plug parallel to the plane, the cable including a bend between the first portion and the second portion.

8. The cable assembly of claim 1, wherein the housing has a maximum width less than a width of the opening of the cage, the housing including at least one channel extending perpendicular to the plane, the at least one channel defining a portion of a second width which is less than the maximum width.

9. The cable assembly of claim 8, wherein the housing includes a lower portion from which the electrical contacts extend and an upper portion from which the cable extends, the at least one channel extending from a lower surface of the housing and along at least one side of the lower portion in a direction toward the upper portion.

10. The cable assembly of claim 9, wherein the plug includes a pair of plug latches located on opposite sides of the upper portion of the housing, each plug latch including an outer surface with a latch opening therein, the latch opening configured to receive a corresponding cage latch provided on the cage, the outer surfaces of the plug latches being separated by a width greater than the second width when the plug is removed from the cage.

11. The cable assembly of claim 10, wherein:

the plug latches are configured to be squeezed toward each other and the sides of the upper portion of the housing to reduce the width of the outer surfaces of the plug latches and generate an outward biasing force; and each plug latch has an outwardly curved configuration.

12. The cable assembly of claim 9, wherein the lower portion is configured to be inserted into the cage through the opening with the upper portion configured to be located outside the cage when the lower portion is positioned in the cage.

13. The cable assembly of claim 12, wherein the at least one channel is configured to cooperate with an insertion key on the cage to permit insertion of the plug into the cage only when the plug is properly aligned with the cage; and the at least one channel located on a side of the plug.

14. The cable assembly of claim 9, wherein the electrical contacts are spaced in accordance with a QSFP specification and the lower portion of the housing defines a plug that fits within the form factor for a QSFP transceiver.

15. A cage for housing a receptacle connector mounted to a circuit board and receiving a plug configured to mate with the receptacle connector, the cage comprising:

a plurality of conductive walls including an upper wall, a pair of side walls connected to the upper wall and an end wall connected to the side walls, the plurality of conductive walls bounding a channel having a first opening at a first end thereof and the end wall at a second end thereof, the second end being located opposite the first end, the upper wall including a second opening therethrough configured to receive the plug into the channel;

a plurality of tails configured to mount the cage to the circuit board, the plurality of tails extending from a portion of the side walls located opposite the upper wall; and at least one cage latch located outside the channel and adjacent the second opening, the at least one cage latch extending from at least one of the plurality of conductive walls in a direction perpendicular to the upper wall, the at least one cage latch configured to secure the plug when the plug is mated with the receptacle connector.

16. The cage of claim 15, further comprising at least one cage key extending into the second opening from one of the plurality of conductive walls in a direction parallel to the upper wall, the at least one cage key configured to cooperate with a corresponding plug key on the plug to align the plug with the second opening.

17. The cage of claim 16, wherein the second opening includes a first portion with a first configuration to receive a first portion of the plug and a second portion with a second configuration to receive a second portion of the plug, the first and second configurations of the first and second portions of the second opening being different from each other.

18. The cage of claim 17, wherein the at least one cage key is located between the first and second portions of the second opening.

19. The cage of claim 16, wherein the at least one cage latch is located between the end wall and the at least one cage key.

20. The cage of claim 16, further comprising at least one connection key extending into the second opening from one of the plurality of conductive walls, the at least one connection key configured to engage and prevent movement of the plug along the channel toward the receptacle connector until the plug is sufficiently inserted in the channel through the second opening to align the plug with the receptacle connector.

21. The cage of claim 20, wherein the connection key includes a first portion extending in a direction parallel to the upper wall and a second portion extending into the channel in a direction perpendicular to the upper wall, the second portion configured to obstruct the plug from movement along the channel until the plug is sufficiently inserted in the channel.

22. The cage of claim 15, further comprising a pair of transceiver latches on the first and second side walls and extending into the channel, the transceiver latches configured to secure a transceiver inserted into the channel through the first opening at the first end.

23. The cage of claim 15, wherein the at least one cage latch includes a pair of cage latches located on opposite sides of the second opening; and each cage latch includes an inwardly directed latch component configured to engage opposing sides of the plug.

24. The cage of claim 15, wherein the channel is configured to receive and guide a transceiver which conforms to a QSFP specification into engagement with the receptacle connector.

25. The cage of claim 15, further comprising at least one guide configured to guide the plug into the channel through the second opening;

wherein the at least one guide extends from the upper wall in a direction away from the channel and the at least one guide is located adjacent the second opening.

26. The cage of claim 25, wherein the at least one guide includes a plurality of guides positioned along segments of the second opening.

27. An electronic system comprising:

a cable including a plurality of signal conductors;

a circuit board including a surface;

a receptacle connector mounted to the surface of the circuit board;

a cage mounted to the surface of the circuit board and housing the receptacle connector therein, the cage including an upper wall positioned above the surface of the circuit board and forming a channel therebetween; and a plug extending through the opening in the upper wall of the cage, the plug including a lower portion and an upper portion, the lower portion including a mating interface positioned in the channel and engaging the receptacle connector, the upper portion being positioned outside the channel and attached to the cable, the plurality of signal conductors of the cable being electrically coupled the mating interface of the plug.

28. The electronic system of claim 27, wherein the opening in the cage is configured to restrict insertion of the plug to a predetermined orientation.

29. The electronic system of claim 27, wherein:

the cage includes a key arrangement configured to limit insertion of the plug into and/or along the channel of the cage;

the key arrangement includes an insertion key configured to align the plug with the opening in the upper wall of the cage; and the key arrangement includes a connection key configured to obstruct movement of the plug along the channel and into engagement with the receptacle connector until the mating interface is aligned with the receptacle connector.

30. The electronic system of claim 27, wherein a portion of the cable outside the cage extends in a direction along the upper wall.

31. The electronic system of claim 27, wherein the cable includes a first end and a second end, the cable being connected to the plug at the first end, the circuit board includes an edge and the cage is mounted to the circuit board with the channel extending from the edge to the receptacle connector, the cable being routed over the surface of the circuit board, and the second end of the cable is electrically connected to a component within the electronic system.

* * * * *